US009711907B2

(12) United States Patent
Tamai

(10) Patent No.: US 9,711,907 B2
(45) Date of Patent: Jul. 18, 2017

(54) CONNECTING BLADE, AND ELECTRICAL CONNECTOR INCLUDING CONNECTING BLADE

(71) Applicant: Hirose Electric Co., Ltd., Tokyo (JP)

(72) Inventor: Nobuhiro Tamai, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/041,126

(22) Filed: Feb. 11, 2016

(65) Prior Publication Data

US 2016/0240951 A1 Aug. 18, 2016

(51) Int. Cl.

| | |
|---|---|
| ***H01R 13/648*** | (2006.01) |
| ***H01R 13/6469*** | (2011.01) |
| ***H01R 12/73*** | (2011.01) |
| ***H01R 13/6476*** | (2011.01) |
| ***H01R 13/6587*** | (2011.01) |

(52) U.S. Cl.

CPC ..... *H01R 13/6469* (2013.01); *H01R 12/73* (2013.01); *H01R 13/6476* (2013.01); *H01R 13/6587* (2013.01)

(58) Field of Classification Search

CPC H01R 23/688; H01R 13/514; H01R 13/6471; H01R 12/716; H01R 23/6873; H01R 13/518; H01R 13/6585

USPC ..... 439/620.15, 607.05, 607.07

See application file for complete search history.

(56) References Cited

U.S. PATENT DOCUMENTS

| | | | | |
|---|---|---|---|---|
| 7,485,009 | B1 * | 2/2009 | Zhu | H01R 23/6873 439/444 |
| 7,837,492 | B2 * | 11/2010 | Zhu | H01R 12/57 439/329 |
| 8,357,013 | B2 * | 1/2013 | Arai | H04M 1/76 379/417 |
| 8,708,755 | B2 * | 4/2014 | Tamai | H01R 13/6469 439/676 |
| 8,753,148 | B2 * | 6/2014 | Wozniak | H01R 12/585 439/607.05 |

FOREIGN PATENT DOCUMENTS

JP 2013-080648 A 5/2013

* cited by examiner

*Primary Examiner* — Xuong Chung Trans

(74) *Attorney, Agent, or Firm* — Kubotera & Associates, LLC

(57) ABSTRACT

A connecting blade includes an insulation board; and a signal line disposed on the insulation board. The signal line has contact points at both ends thereof for connecting to a circuit connecting member. The signal line is formed of a metal band member. The signal line is arranged on the insulation board in a width direction of the signal line. The insulation board includes a cut portion penetrating through the insulation board or being recessed in a plate surface of the insulation board. The cut portion is situated at a position where the cut portion exposes a part of the signal line.

13 Claims, 6 Drawing Sheets

CONNECTING BLADE, AND ELECTRICAL CONNECTOR INCLUDING CONNECTING BLADE

BACKGROUND OF THE INVENTION AND RELATED ART STATEMENT

The present invention relates to a connecting blade, which connects two electrical connectors, and an electrical connector having the connecting blade.

Patent Reference has disclosed a conventional connecting blade that connects two electrical connectors. In the conventional connecting blade disclosed in Patent Reference, a plurality of signal line materials made of metal band members is arranged in a width direction of the signal lines, and is held with an insulation board made of an electrically insulating material through an integral molding. The integral molding is performed by injecting an electrically insulating material into a molding die, while maintaining a state that the signal line materials is arranged in the molding die. At this time, the signal line materials receive a pressure during the injection of the electrically insulating material in the molding die. Therefore, it is necessary to restrict movements of the signal line materials in a width direction and/or a sheet thickness direction thereof, so that the signal line materials are not displaced from the normal positions.

In the conventional connecting blade disclosed in Patent Reference, in order to restrict the movements of the signal line materials, a restricting portion may be provided in the molding die. The restricting portion presses both plate surfaces and both side end surfaces of the signal line materials over the whole circumference of the signal line materials at least one position such as a longitudinal direction of the signal line materials. As a result, it is achievable to hold the signal line materials at the normal positions. According to the conventional connecting blade made by such a method, at the positions where the restricting portion of the molding die is provided, the whole circumferences of the signal lines are exposed from the insulation board and contact with air.

Patent Reference: Japanese Patent Application Publication No. 2013-080648

According to the conventional connecting blade disclosed in Patent Reference, the portion where the signal lines are exposed from the insulation board and contact with air, the effective permittivity becomes smaller than that of portions of the signal lines that are covered by the insulation board. As a result, an impedance thereof tends to be higher. In other words, in the conventional connecting blade, there is a difference in the impedance between the portion of the signal lines covered by the insulating material and the portion of the signal lines exposed from the insulating material. For this reason, the impedance tends to vary in the longitudinal direction of the signal lines.

As described above, according to the conventional connecting blade disclosed in Patent Reference, there is the impedance mismatch in the longitudinal direction of the signal lines. As a result, a signal may be deteriorated due to reflection, thereby causing an undesirable effect. Especially, when signals to transmit by the signal lines are high-speed signals, strict impedance matching is required. Therefore, it is necessary to minimize the impedance mismatch.

On the other hand, when the whole circumferential surfaces of the signal lines are covered by the insulation board, in order to match the impedance over the whole range of the signal lines in the longitudinal direction thereof, it is difficult to provide the restricting portion in the molding die to restrict the displacement of the signal line materials. For this reason, it is difficult to maintain the signal lines at the normal positions during the integral molding.

In view of the above problems, an object of the present invention is to provide a connecting blade and an electrical connector having the connecting blade, which can minimize the impedance mismatch of signal lines thereof, while preventing displacement of the signal lines during the integral molding.

SUMMARY OF THE PRESENT INVENTION

In order to attain the objects described above, according to a first aspect of the present invention, the above-described problems may be solved by a connecting blade according to a first embodiment, and an electrical connector having the connecting blades according to a second embodiment.

According to the first aspect of the present invention, in the connecting blade, each of the signal lines is made from a metal band member and has contact points at both ends, which connect two circuit connecting members. The plurality of signal lines is arranged in a width direction of the signal lines and is held on an insulation board by integral molding.

According to the first aspect of the present invention, in the connecting blade, the insulation board has cutout portions that penetrate the insulation board in the sheet thickness direction or are dented from the plate surface of the insulation board at least one position in a longitudinal direction of the signal lines. The cutout portions are formed by removing a molding die after integral molding, which restrict positions of the signal lines in the width direction and the sheet thickness direction of the signal lines upon integral molding. The cutout portions are formed so as to expose the sheet thickness surfaces of the signal lines and a part of plate surfaces of the signal lines in the width direction.

As described above, according to the first aspect of the present invention, the cutout portions are formed to expose the sheet thickness surfaces of the signal lines and a part of plate surfaces of the signal lines in the width direction, i.e., only very narrow range of the circumferential surfaces of the signal lines. Therefore, in the signal lines of the connecting blade, their plate surfaces of the range other than the above-described part that receives restriction of positions by molding die upon integral molding. As a result, effective permittivity is high and impedance is small, in comparison with a case the whole circumferential surfaces of the signal lines are exposed as in conventional technique. In other words, it is achievable to minimize mismatching of the impedance in the longitudinal direction of the signal lines than that in conventional technique. Moreover, upon integral molding, the signal lines are restricted from movements in the width direction and the sheet thickness direction by the molding die in the exposed sheet thickness surfaces and the part of the plate surfaces. Therefore, it is achievable to securely keep the signal lines at the normal positions.

According to the first aspect of the present invention, the cutout portions of the insulation board can be formed at positions so as to expose plate surfaces of one of side edges of the signal lines in the width direction of the signal lines and the side end surfaces. When the cutout portions are formed at those positions, upon integral molding, the molding die abuts the plate surfaces of the side edges, so that it is achievable to restrict the movements of the signal lines in the sheet thickness direction. In addition, the molding die abuts the side end surfaces of the side edges, so that it is achievable to restrict the movements of the signal lines to the one side edges in the width direction.

According to the first aspect of the present invention, the cutout portions of the insulation board can be formed on each of the both sides of the signal lines in the width direction of the signal lines. When the cutout portions are formed corresponding to each of the both side edges of the signal lines, it is achievable to restrict the movements of the signal lines in any orientation in the width direction by the molding die.

According to the first aspect of the present invention, as for the cutout portions of the insulation board, the cutout portions formed on one side of the signal lines in the width direction of the signal lines and the cutout portions formed on the other side can be provided at different positions in the longitudinal direction of the signal lines.

If the cutout portions on one side and the cutout portions on the other side are formed at the same positions in the longitudinal direction of the signal lines, the exposed areas of the signal lines at positions where the cutout portions are provided in the longitudinal direction increase in comparison with when the cutout portions are provided on only one side, and it is not preferred. By providing the cutout portions on one side and the cutout portions on the other side at different positions in the longitudinal directions, it is achievable to minimize the exposed area of the signal lines, while restricting the positions of the signal lines in the width direction.

According to the first aspect of the present invention, in each of the signal lines, there may be formed restricting holes in intermediate area of the signal line in the width direction for restricting the position of the signal line. The restricting holes may be formed to penetrate the signal lines in the sheet thickness direction. The cutout portions of the insulation board may expose at least a part of the circumferential range of the inner circumferential plate surfaces of the restricting holes and inner circumferential sheet thickness surfaces of the restricting holes. By providing the restricting holes in the signal lines in this way, it is achievable to restrict the movements of the signal lines in the sheet thickness direction and the width direction of the signal lines upon integral molding. According to the first embodiment, the signal lines may have parts, which have larger width than other parts, at positions corresponding to the cutout portions in the longitudinal direction of the signal lines. When the width of the signal lines is increased, the distance between the signal lines is smaller. Therefore, when the width of the signal lines is increased and the distance between the signal lines is reduced, the actual permittivity can be higher, and in turn the impedance can be smaller.

Accordingly, by increasing the width of the signal lines at positions corresponding to the cutout portions so as to increase the effective permittivity, it is achievable to cancel or restrict reduction in the actual permittivity due to exposure of the signal lines at the cutout portions. As a result, it is achievable to restrict the increase of the impedance at the positions of the cutout portions in the longitudinal direction of the signal lines, and to reduce mismatching of the impedance.

According to the first aspect of the present invention, in the connecting blade, the grounding lines may be juxtaposed being adjacent to the signal lines and are held by an insulation board by integral molding. The grounding lines may be disposed so as to have their side edges of parts at positions corresponding to the cutout portions in the longitudinal direction of the grounding lines be closer to the signal lines than other parts of the side edges. When the side edges of the grounding lines are close to the signal lines, the effective permittivity is high, and in turn the impedance is small.

Accordingly, by having the side edges of the grounding lines be closer to the signal lines at positions corresponding to the cutout portions, it is achievable to cancel or restrict reduction in the effective permittivity due to exposure of the signal lines at the cutout portions. As a result, it is achievable to restrict the increase of the impedance at the positions of the cutout portions in the longitudinal direction of the signal lines, and to reduce mismatching of the impedance.

According to a second aspect of the present invention, an electrical connector having connecting blades includes a plurality of the connecting blades of the first embodiment and a housing. The plurality of the connecting blades is held in the housing at certain intervals. The housing is opened at both ends, where contact points of the connecting blades are located. At the contact points, a mating connector can connect to the electrical connector, and can fit to the housing. According to this electrical connector, while obtaining the effects of the connecting blade of the first embodiment, it is achievable to connect two mating connectors.

As described above, according to the present invention, the cutout portions of the insulation board are formed so as to expose the sheet thickness surfaces of the signal lines and a part of the both plate surfaces of the signal lines. Therefore, effective permittivity can be high and in turn the impedance can be low in comparison with when the whole circumferential surfaces of the signal lines are exposed as in conventional technique. As a result, it is achievable to reduce mismatching of the impedance in the longitudinal direction of the signal lines more than in conventional technique. In addition, upon integral molding, movements of the signal lines in the width direction and the sheet thickness direction are restricted by the molding die. Therefore, it is achievable to keep the signal lines at the normal positions.

BRIEF DESCRIPTION OF THE DRAWINGS

FIGS. 2(A), 2(B), and 2(C) are views showing the connecting blade used in the intermediate connector of FIG. 1, wherein FIG. 2(A) is a perspective view of the connecting blade, FIG. 2(B) is a perspective view of straight pairs, cross pairs, and grounding lines, which are arranged in the connecting blade before integral molding with an insulation board of the connecting blade of FIG. 2(A), and FIG. 2(C) is a front view of a left half part of the connecting blade of FIG. 2(A);

FIGS. 3(A), 3(B), 3(C), and 3(D) are perspective views the straight pair, the cross pair, and the grounding line of the connecting blade, wherein FIG. 3(A) is an extracted view of the straight pair of FIG. 2(B), FIG. 3(B) is an extracted view of the cross pair of FIG. 2(B), FIG. 3(C) is an extracted view of the grounding line of FIG. 2(B), and FIG. 3(D) is an enlarged view of a cross area of the cross pair of FIG. 3(B);

FIGS. 4(A), 4(B), and 4(C) are partial views of the connecting blade of FIG. 2(A), wherein FIG. 4(A) is a front view in which a part of outer shapes of the signal lines and the grounding line that is embedded in the insulation board is indicated with broken lines, and FIGS. 4(B) and 4(C) are sectional views of the connecting blade of FIG. 4(A) with a molding die, taken at a surface perpendicular to a longitudinal direction of the lines, in which FIG. 4(B) is the view at a window and FIG. 4(C) is a view at a short notch portion;

FIGS. 5(A) and 5(B) are views of a part of a connecting blade according to a second embodiment, wherein FIG. 5(A) is a front view in which a part of outer shapes of the signal lines and the grounding line that are embedded in the insulation board is indicated with broken lines, and FIG. 5(B) is a sectional view of the connecting blade of FIG. 5(A) with the molding die at position of a restricting hole, which is taken at a surface perpendicular to a longitudinal direction of the lines; and FIGS. 6(A), 6(B), and 6(C) are views of a part of the connecting blade according to a third embodiment, wherein FIG. 6(A) is a front view in which a part of outer shapes of the signal lines and the grounding line that is embedded in the insulation board is indicated with broken lines, and FIGS. 6(B) and 6(C) are sectional views of the connecting blade of FIG. 6(A) with a molding die, taken at a surface perpendicular to the longitudinal direction of the lines, in which FIG. 6(B) is the sectional view at a holed concave portion and FIG. 6(C) is the sectional view at a notched concave portion.

DETAILED DESCRIPTION OF THE PREFERRED EMBODIMENTS

Hereunder, embodiments of the present invention will be described with reference to the accompanying drawings.

First Embodiment

Figure 1:
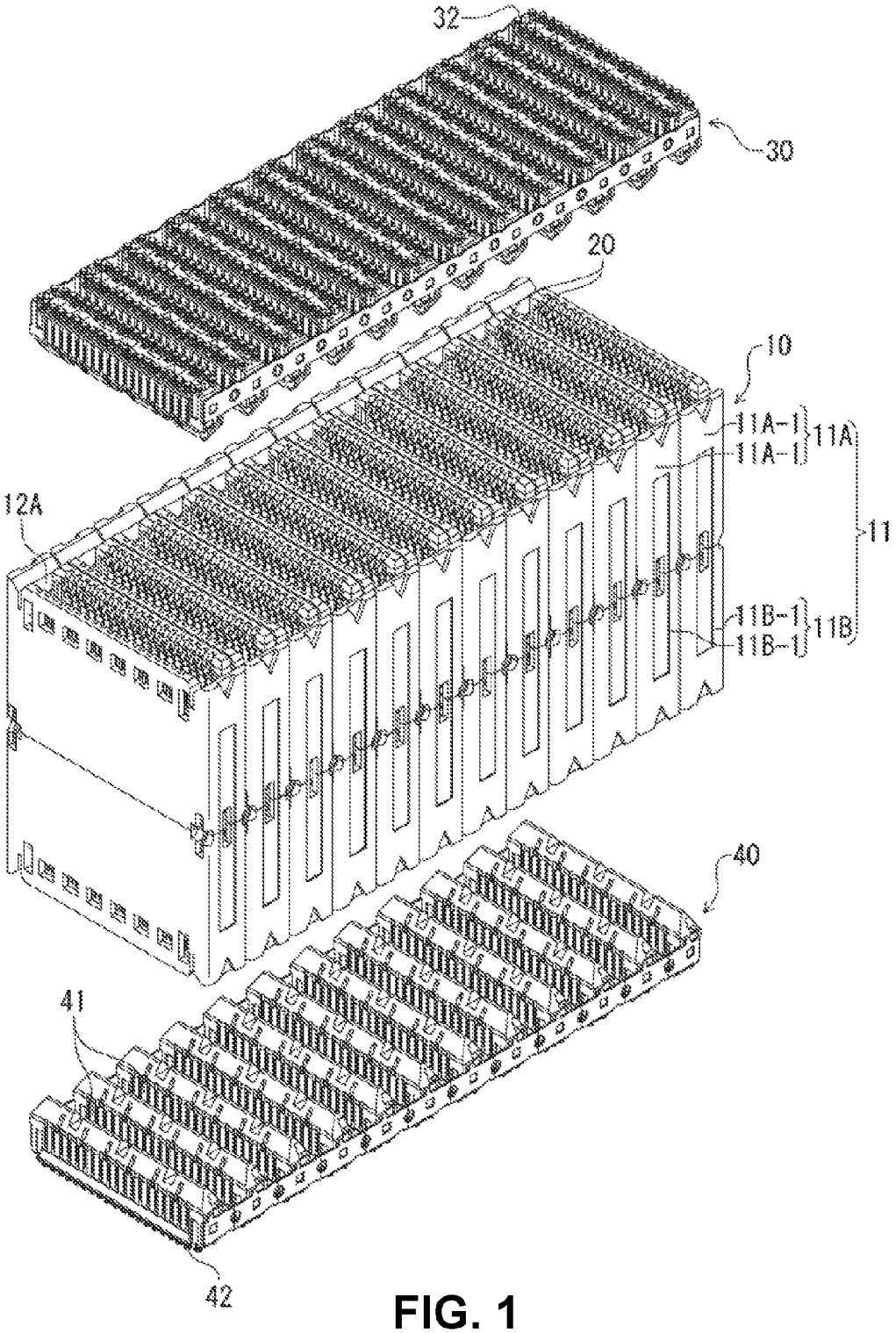
FIG. 1 is a perspective view showing an outer appearance of an intermediate electrical connector having connecting blades and two mating connectors that connect to the intermediate electrical connector according to a first embodiment of the present invention.

FIG. 1 is a perspective view showing an intermediate connecting electrical connector 10 and two mating connectors 30 and 40 that are circuit connecting members to connect to the intermediate electrical connector 10, which are in a state before connecting. The intermediate electrical connector 10 has a plurality of connecting blades 20 of the present invention, which is held by an insulating holding body 11.

The intermediate connecting electrical connector 10 includes a group of connecting blades, which is composed of a plurality of connecting blades 20, which will be described later. The connecting blades 20 are positioned and held from above and below by an upper holding body 11A and a lower holding body 11B, which form an insulating holding body 11 and serve as a rectangular piped housing. In the insulating holding body 11, the connecting blades 20 are positioned so as to have their plate surfaces parallel to each other. The upper holding body 11A is composed of a plurality of block-like bodies 11A-1. Each of the block-like bodies 11A-1 has a holding hole 12A that penetrates in an up-and-down direction so as to accommodate and hold an upper part of two connecting blade 20. The lower holding body 11B is composed of a plurality of block-like bodies 11B-1. Each of the block-like bodies 11B-1 has a holding hole (not illustrated in FIG. 1) that penetrates in an up-and-down direction so as to accommodate and hold a lower part of two connecting blade 20. The insulating holding body 11 is composed of the upper holding body 11A and the lower holding body 11B. At the holding holes 12A of the respective block-like bodies 11A-1 and the holding holes of the respective block-like bodies 11B-1, the insulating holding body 11 is opened upwardly and downwardly so as to fit and receive fitting parts of the mating connectors 30 and 40 to join. As a result, connecting points of the connecting blades 20 can contact and connect to terminals of the connectors 30 and 40. The mating connectors 30 and 40 have substantially the same shape. In FIG. 1, the mating connector 40 is disposed being flipped upside down relative to the mating connector 30.

On the other hand, the mating connectors 30 and 40 have slit-like openings 41 for the number of the connecting blades 20, which compose the group of the connecting blades, on the sides directing to the intermediate connecting electrical connector 10. Here, the slit-like openings of the mating connector 30 are directed downward and hidden in the figure. In addition, on the other sides, there are provided solder balls 32 and 42, which are attached to terminals. The both mating connectors 30 and 40 are to be connected to corresponding circuit portions of respective corresponding circuit boards (not illustrated) at the solder balls. Accordingly, while being attached to respective corresponding circuit boards, the mating connectors 30 and 40 face each other as shown in FIG. 1, and are connected via the intermediate connecting electrical connector 10.

Figure 2:
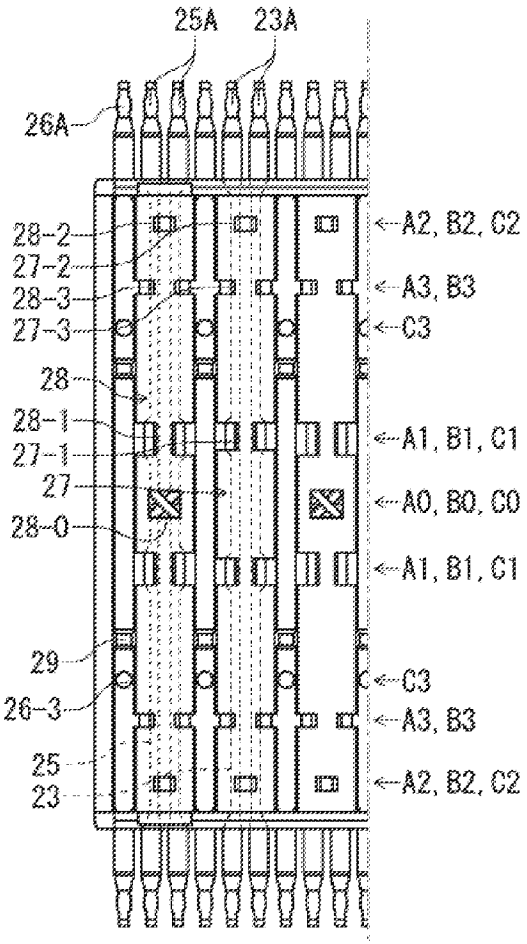
Figure 2:
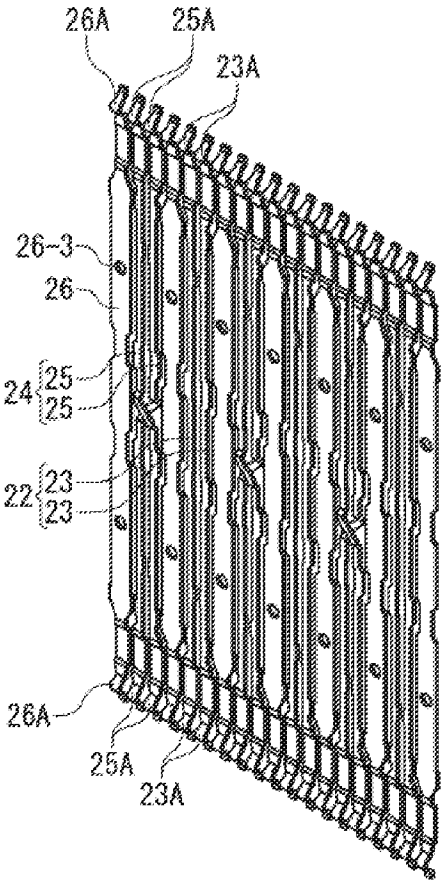
Figure 2:
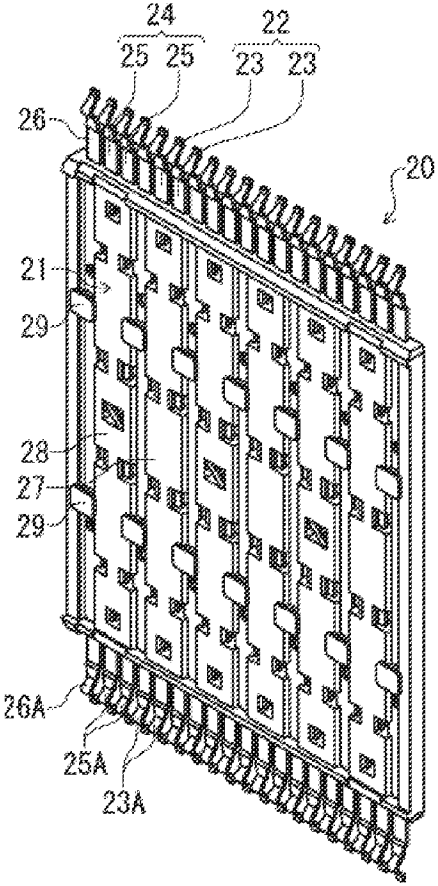

As shown in FIG. 2(A) and FIG. 2(B), in which the insulation board 21 is omitted, the connecting blade 20 includes a pair of signal lines 23, i.e., straight pair 22, a pair of signal lines 25, i.e., a cross pair 24, a pair of signal lines 25, and grounding line 26. The straight pairs 22, the cross pairs 24, and the grounding lines 26 are held by the insulation board 21 by integral molding to the insulation board, which is made of an electrically insulating material.

The straight pairs 22 and the cross pairs 24 are differential paired lines for signals. The straight pairs 22, the cross pairs 24, and the grounding lines 26 are made, for example, by punching sheet metal to strips and then partially bending the strips in the sheet thickness direction. As shown in FIG. 2(B), on the insulation board 21, the grounding line 26, the cross pair 24, the grounding line 26, and then straight pair 22 are repeatedly arranged in the order. Any of the lines 23, 25, and 26 extends to edges of the both ends (upper and lower ends in FIG. 2(B)) of the insulation board 21. On the both ends, the lines 23, 25, and 26 have contact points 23A, 25A, and 26A, respectively.

As shown in FIG. 3(A), the pair of signal lines 23, which form the straight pair 22, is laterally and vertically symmetrical. As already described, each of the signal lines 23 has contact points 23A at its both ends, and also has a center position A0, positions A1, positions A2, and intermediate positions A3. The center position A0 is a center of the signal line 23 in a longitudinal direction (up-and-down direction). The positions A1 are positions close to the center position A0 in the longitudinal direction. The positions A2 are positions close to the ends, which are close to the contact points 23A. The intermediate positions A3 are positions between the positions A1 and the positions A2. At the two intermediate positions A3, a side edge of the signal line 23 slightly project and form wide portions 23-1, 23-2, and 23-3. However, between the contact points 23A at the ends of the signal line 23, the line width is substantially same and the signal line 23 has a straight shape.

Figure 3:
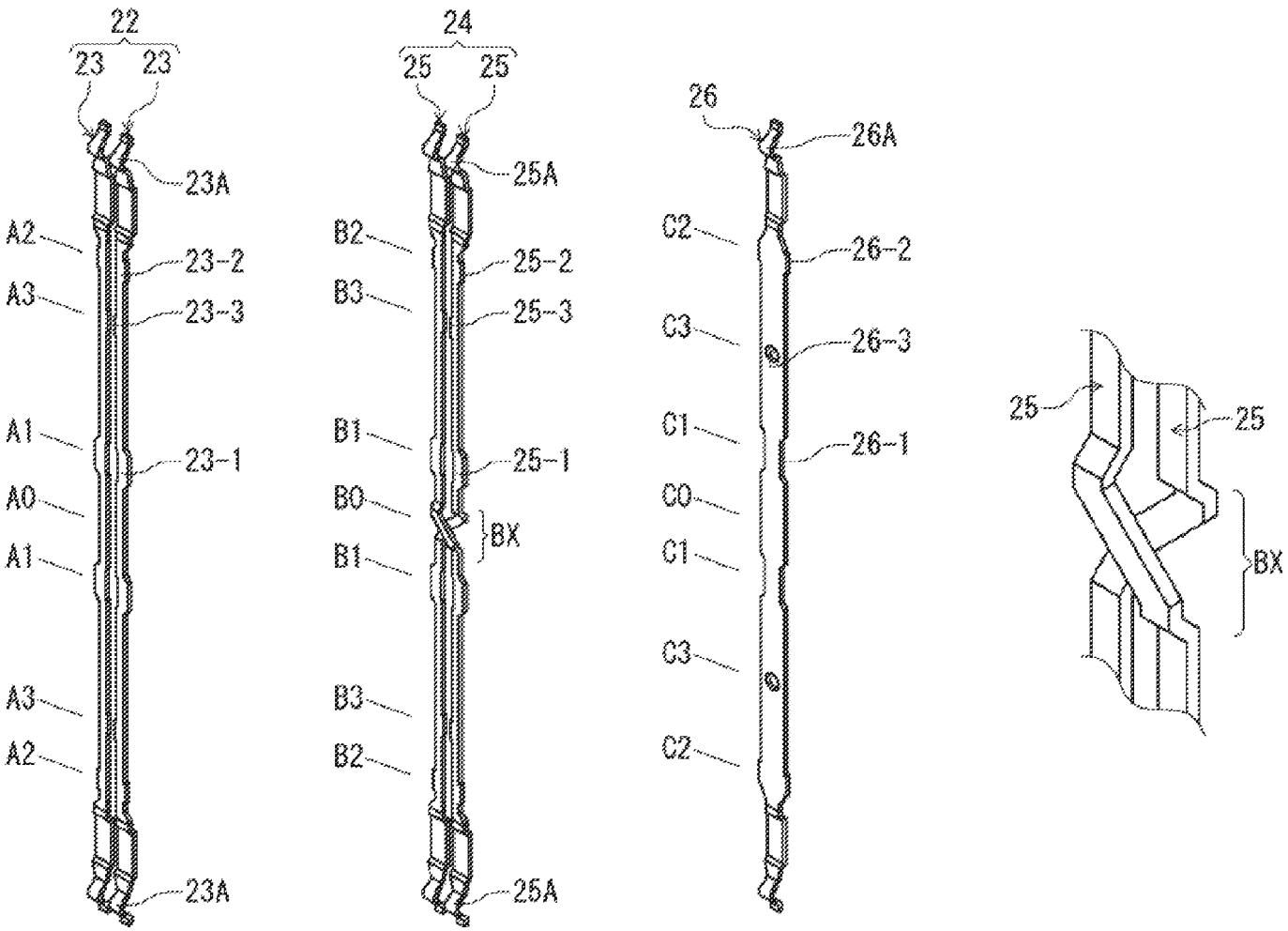

As shown in FIG. 3, when a pair of signal lines 23 is disposed as the straight pair 22, the wide portions 23-1 and 23-2 are formed with the side edge projecting outward. On the other hand, the wide portions 23-3 are formed with the side edge projecting inward.

Next, the signal lines 25, which form the cross pair 24, have contact points 25A at the both ends and has a center position B0 and other positions B1, B2, and B3 similarly to the lines 23 of the straight pair 22. As shown in FIG. 3(B), other than the position B0 and a cross area BX near the center position B0, the signal lines 25 of the cross pair 24 have the same shape as that of the signal lines 23 of the straight pair 22. AT the cross area BX, one signal line 25 and the other signal line 25 are bent so as to be away from each other in the sheet thickness direction and thereby cross each other without contacting (See FIG. 3(D) for an enlarged view of the cross area).

The respective wide portions 25-1, 25-2, and 25-3 at the positions the center position B1, the positions B2, the intermediate positions B3 in the longitudinal direction are also similarly formed to those of the signal line 23 of the straight pair 22. As shown in FIG. 3(C), each of the grounding line 26 has contact points 26A at the both ends, and is formed as a wider strip than the signal lines 23 of the straight pairs 22 and the signal lines 25 of the cross pairs 24. Similarly to the signals lines 23 of the straight pairs 22, each of the grounding lines 26 has positions a center position C0, positions C1, positions C2, and intermediate positions C3. At the positions C1, which are close to and provided on sides of the center position C1 in the longitudinal direction, there are formed narrow portions 26-1. At the positions C2, which are close to the ends, there are formed wide portions 26-2. In the grounding lines 26, the intermediate positions C3 are provided closer to the center position C0 in comparison to the closeness of the intermediate positions A3 to the center position A0 or of the intermediate positions B3 to the center position B0. At the intermediate positions, there are connecting holes 26-3 to connect to a grounding plate (not illustrated).

Accordingly, the signal lines 23 of the straight pairs 22, the signal lines 25 of the cross pairs 24, and the grounding lines 26 are formed as shown in FIGS. 3(A), 3(B), and 3(C). Being arranged inside a molding die (not illustrated) as shown in FIG. 2(B), the signal lines 23 and 25 and the grounding lines 26 are integrally molded with an insulating material such as resin as shown in FIG. 2(A) to be held by the insulation board 21. As a result, the connecting blade 20 is formed as a whole.

As shown in FIG. 2(A), in the connecting blades 20, the contact points 23A are provided on the both ends of the signal lines 23 of the straight pairs 22. The contact points 25A are provided on the both ends of the signals lines 25 of the cross pairs 24. The contact points 26A are provided on the both ends of the grounding lines 25. The contact points 23A, 25A, and 26A protrude from upper and lower edges of the insulation board 21.

As shown in FIGS. 2(A) and 2(C), the insulation board 21 has most part of plate surfaces of the straight pairs 22 and the cross pairs 24 be embedded therein to hold, except the contact points 23A and 25A, which protrude and are exposed from therefrom. The insulation board 21 holds the grounding lines 26 at their side edges. The side edges of the grounding lines 26 are partially embedded therein except the contact points 26A, which protrude and are exposed from the insulation board 21. The insulation board 21 hold the grounding lines 26 at the side edges, while exposing most part of surfaces of the grounding lines 26. Each of the grounding line 26 has the narrow portion 26-1 at the positions C1 as shown in FIG. 3(C), so that the narrow portions 26-1 are not held by the insulation board 21.

As described above, in the connecting blade 20, the insulation board 21 holds the straight pairs 22, the cross pairs 24, and the grounding lines 26. In addition, according to the embodiment, there are the grounding plates (not illustrated) attached to both plate surfaces of the connecting blade 20. On one grounding plate (for example, the one attached on a plate surface that is visible in FIGS. 2(A) and 2(C)), there are formed ribs that contact with exposed parts of the grounding lines 26 and extend in the up-and-down direction. The ribs are held by protrusions 29 (see FIGS. 2(A) and 2(C)) provided on the insulation board 21, which will be described later. On the other grounding plate (a plate surface which is behind and not visible in FIGS. 2(A) and 2(C)), there are formed ribs, similarly to those formed on the one grounding plate. Those ribs are also held by protrusions 29 provided on the insulation board 21, which will be described later.

Furthermore, on the one and the other grounding plates, there are provided protrusions, which protrude from edges that extend in an up-and-down direction of the respective ribs. The respective protrusions on the one and the other grounding plates penetrate the connecting holes 26-3 formed on the grounding lines 26 and then contact with the ribs of the other and the one grounding plates.

As well shown in FIG. 2(C), on embedding strips 27 that cover the straight pairs 22 and embedding strips 28 that cover the cross pairs 24, there are formed notched portions 27-1, 27-3, 28-1, and 28-3 and window-like openings 27-2 and 28-2 at a plurality of positions in the longitudinal direction (the up-and-down direction in FIG. 2(C)) as cutout portions that penetrate in the sheet thickness direction of the insulation board 21. Those notched portions 27-1, 27-3, 28-1, and 28-3 and window-like openings 27-2 and 28-2 are formed as a result of pulling out to remove after molding a restricting protrusions P3 and Q3 (see FIGS. 4(B) and 4(C)) of molding dies P and Q, which restrict positions of the straight pairs 22 and the cross pairs 24 in their width direction (left-and-right direction in FIG. 2(C)) and in their sheet thickness direction (a direction perpendicular to the paper's plate surface of FIG. 2(C)) upon molding the insulation board 21.

First, on the side edges of each embedding strip 27 that covers the straight pair 22, there are formed long notched portions 27-1 at positions corresponding to the positions A1 of the straight pairs 22. There are also formed short notched portions 27-3 at positions corresponding to the intermediate positions A3. In addition, in the center of the embedding strips 27 in the width direction, there are formed window-like openings 27-2 at positions corresponding to the positions A2.

As shown in FIG. 2(C), the notched portions 27-1 and 27-3 are opened outward in the width direction at the both side edges of each of the embedding strips 27 and penetrate in the sheet thickness direction. In the respective notched portions 27-1 and 27-3, side edges of the signal lines 23 of one of the straight pairs 22, which are opposite side edges relative to each other (hereinafter referred to as "outer side edges"), are exposed at inner positions (positions not opened) in the width direction. In other words, in the notched portions 27-1, side ends (sheet thickness surfaces) of the outer edges and the both plate surfaces of the wide portions 23-1 are exposed. In the notched portions 27-3, the side end surfaces (sheet thickness surfaces) of the outer edges and both plate surfaces of the wide portions 23-3 are exposed.

As shown in FIG. 2(C), the window-like openings 27-2 are formed as quadrilaterals that extends over two facing adjacent side edges (hereinafter referred to as "inner side edges") of the signal lines 23 of one straight pair 22, and penetrate in the sheet thickness direction. Inside the window-like openings 27-2, side end surfaces (sheet thickness surfaces) of the inner edges and the both plate surfaces of the wide portions 23-2 of the respective signal lines 23 are exposed at the both side positions in the width direction.

The side edges of the wide portions 23-1, 23-2, and 23-3 exposed from the insulation board 21 are very small in comparison with the whole signal lines 23. The straight pairs 22 substantially have their most parts except the contact points 23A be embedded in the insulation board 21.

Next, on the side edges of each of the embedding strips 28 that cover the cross pairs 24, there are formed long notched portions 28-1 at positions corresponding to the positions B1 of the cross pair 24. At the positions corresponding to the intermediate positions B-3, there are formed short notched portions 28-3. At the center of each of the embedding strips 28 in the width direction, there are formed window-like openings 28-2 at positions corresponding to the positions B2 (See also FIG. 4(A) for the notched portions 28-1 and the window-like portions 28-2).

As shown in FIG. 2(C), the notched portions 28-1 and 28-3 are opened outward in the width direction at both side edges of each of the embedding strips 28, when viewed in the sheet thickness direction of the insulation board 21 (a direction perpendicular to the paper surface). The notched portions 28-1 and 28-3 penetrate in the sheet thickness direction.

In the respective notched portions 28-1 and 28-3, two facing adjacent side edges (hereinafter referred to as "outer edges") of the signal lines 25 of one cross pair 24 are exposed at inner positions (positions on the side not opened) in the width direction. In other words, in the notched portions 28-1, the side end surfaces (sheet thickness surfaces) and the both plate surfaces of the wide portions 25-1 are exposed. In the notches 28-3, the side end surfaces (sheet thickness surfaces) and the both plate surfaces of the wide portions 25-1 are exposed.

As shown in FIG. 2(C), the window-like openings 28-2 are formed as quadrilaterals that extend over the two facing adjacent side edges (hereinafter referred to as "inner edges") of the signal lines 25 of one cross pair 24 and penetrate in the sheet thickness direction. In the window-like openings 28-2, at the both positions in the width direction, the side end surfaces (sheet thickness surfaces) of the inner edges and the both plate surfaces of the wide portions 25-2 of the respective signal lines 25 are exposed.

Moreover, in each of the embedding strips 28 that covers one cross pair 24, there are formed window-like adjustment area that expose a cross area BX provided at the center position B0 of the cross pair 24. Since the cross area BX of each of the cross pairs 24 is exposed at the window-like adjustment area 28-0, an air layer, where there is no insulating material, is formed in the insulation board 21 that supports the cross pair 24 within the range of the adjustment area 28-0. Therefore, the cross pairs 24 are longer at the cross areas BX than the straight pairs 22 that do not have such adjustment areas 28-0, but the insulation board 21 has such air layers that have lower permittivity than that of the insulation board. As a result, it is achievable to enhance the signal transmission speed for the amount of being low in the permittivity in comparison with the insulation board 21. Furthermore, it is also achievable to reduce the time lag from the straight pairs 22 in signal transmission, and it is even achievable to eliminate the time lag in signal transmission depending on the size of the adjustment areas 28-0 to set. Similarly to the notched positions 28-1 and 28-3 and the window-like openings 28-2, such window-like adjustment areas 28-0 can be made by positioning restricting protrusions of a molding die and then pulling to remove the restricting protrusions after the molding.

The side edges of the wide portions 25-1, 25-2, and 25-3 and the cross areas BX, which are exposed from the insulation board 21, are very small in comparison with the whole signal lines 25. Most parts of the cross pairs 24 except the contact points 25A are substantially embedded in the insulation board 21.

As shown in FIG. 2(C), the insulation board 21 has protrusions 29 at two positions in the longitudinal direction near the connecting holes 26-3. Those protrusions 29 protrude in the sheet thickness direction from the both plate surfaces of the insulation board 21. The protrusions 29 are formed as short rectangular prisms protruding in a direction perpendicular to the paper surface in FIG. 2(C) in a state before the grounding plates (not illustrated) are attached.

Then, after attaching the grounding plates at the corresponding holes formed on the grounding plates to those protrusions 29, those protrusions 29 are crushed to spread in molten state, so as to secure the grounding plates as if they are flat rectangular rivets as shown in FIG. 2(A). Accordingly, those grounding lines 26 are embedded in the insulation board 21 at very narrow parts where the protrusions 29 are present. Here, in FIG. 2(A), illustration of the secured grounding plates is omitted.

According to the embodiment, as described above, the notched portions 27-1, 27-3, 28-1, and 28-3 and the window-like openings 27-2 and 28-2 of the insulation board 21 are formed to expose only the side end surfaces of the side edges of the signal lines 23 and 25 and the both plate surfaces in the width direction, i.e. only very narrow range of circumferential surfaces of the signal lines 23 and 25.

As a result, in the signal lines 23 and 25 of the connecting blade 20, most ranges other than the above limited ranges are covered by the insulating material. Therefore, the actual permittivity is high, and in turn the impedance is small in comparison with when the whole circumferential surfaces of the signal lines are exposed as in conventional technique. In other words, it is achievable to keep mismatching of impedance in the longitudinal direction of the signal lines 23 and 25 smaller than that in conventional technique.

Furthermore, according to the embodiment, as shown in FIG. 2(C), each of the signal lines 23 and 25 has notched portions 27-1, 27-3, and 28-1 and 28-3 on one side edge and window-like openings 27-2 and 28-3 on the other side edge. The notched portions 27-1, 27-3, 28-1, and 28-3 are formed at different positions in the longitudinal direction of the signal lines 23 and 25 from those of the windows 27-2 and 28-2. As a result, in comparison with when the notched portions and the window-like openings are formed at the same positions in the longitudinal directions of the signal lines, it is achievable to reduce the exposed areas of the signal lines 23 and 25 at the positions in the longitudinal direction. Therefore, it is achievable to improve the effect of restricting the mismatching of the impedance.

Moreover, according to the embodiment, in the signal lines 23 and 25, at the positions of the notched portions 27-1, 27-3, 28-1, and 28-3 of the insulation board 21, the wide portions 23-1, 23-3, 25-1, and 25-3 are exposed. As the positions of the window-like openings 27-2 and 28-2, the wide portions 23-2 and 25-2 are exposed. Accordingly, by increasing the width of the exposed parts of the signal lines 23 and 25, it is achievable to cancel or restrict reduction in the effective permittivity due to exposure of the signal lines 23 and 25. As a result, it is achievable to restrict the increase of the impedance at the exposed parts in the longitudinal direction of the signal lines 23 and 25, and to reduce mismatching of the impedance.

In addition, according to the embodiment, the grounding lines 26 have wide portions 26-2 at the positions C2, which are the same as positions A2 and B2 of the signal lines 23 and 25, where the wide portions 27-2 and 28-2 are formed.

The side edges of the wide portions 26-2 are provided being closer to the signal lines 23 and 25 than the side edges at other portions. Accordingly, by providing the side edges of the wide portions 26-2 of the grounding lines 26 close to the signal lines 23 and 25, it is achievable to set off or restrict the reduction of the effective permittivity due to the exposure of the signal lines 23 and 25. As a result, it is achievable to restrict the increase of the impedance at the wide portions 27-2 and 28-2 in the longitudinal direction and reduce the mismatching of the impedance.

According to the embodiment, in the respective signal lines 23 and 25, the cutout portions (notched portions and window-like openings) are formed on the both side of the signal lines 23 and 25 in the width direction, but those cutout portions can be formed only on one side. With this configuration, it is achievable to further reduce the exposed area of the signal lines 23 and 25 and thereby satisfactorily further restrict the mismatching of the impedance. In addition, according to the embodiment, in the respective signal lines 23 and 25, the cutout portions formed on one side in the width direction and the cutout portions formed on the other side are provided at different positions in the longitudinal direction of the signal lines 23 and 25. However, the cutout portions on the one side and the cutout portions on the other side can be formed at the same positions in the longitudinal direction. Furthermore, according to the embodiment, in the respective signal lines 23 and 25, the cutout portions are formed in a plurality of positions in the longitudinal direction, but can be formed only one position in the longitudinal direction.

Next, a step of manufacturing the connecting blade 20 will be described. As described above, according to the embodiment, the signal lines 23 of the straight pairs 22, the signal lines 25 of the cross pairs 24, and the grounding lines 26 (hereinafter, also simply referred to as "lines 23, 25, and 26" for convenience) are made by arranging the lines 23, 25, and 26 inside the molding die in the order as shown in FIG. 2(B), while being in a state before cutting the both ends of the lines 23, 25, and 26 in the longitudinal direction from the carriers (not illustrated), and then integral molding with an insulating material such as resin as shown in FIG. 2(A), so as to hold the lines 23, 25, and 26 on the insulation board 21.

Figure 4:
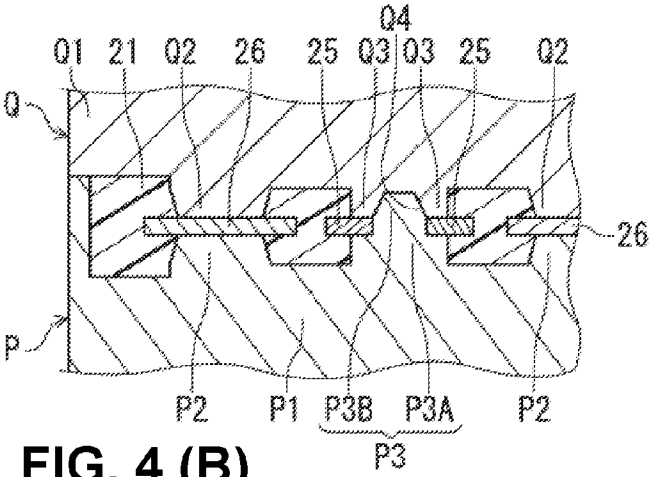
Figure 4:
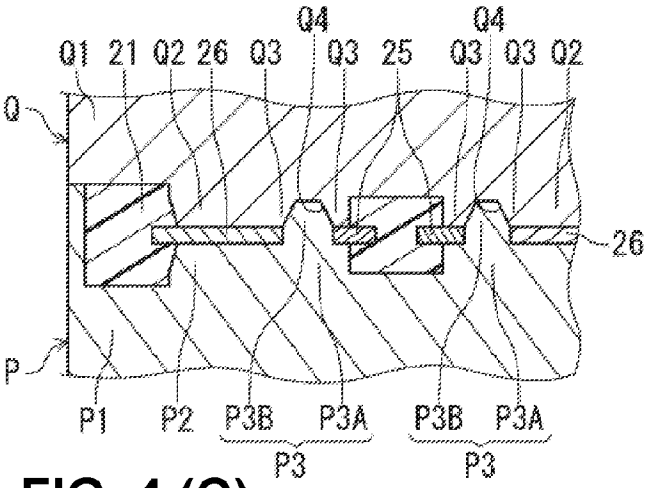
Figure 4:
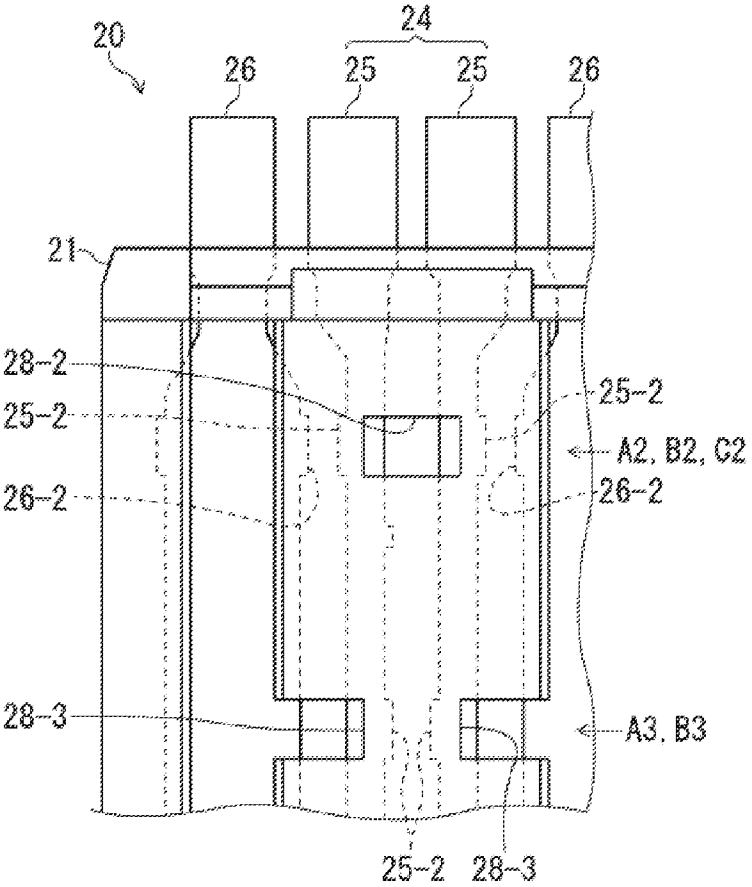

Prior to describe the manufacturing steps of the connecting blade 20 in detail, a shape of the molding die will be described based on FIGS. 4(A) through 4(C). FIG. 4(A) is a front view showing a part of the connecting blade 20. In the figure, parts of outer shapes of the signal lines 23 and 25 and the grounding lines 26, which are embedded in the insulation board 21, are indicated with broken lines. FIGS. 4(B) and 4(C) are sectional views of the connecting blade 20 with the molding die, taken at a surface perpendicular to the up-and-down direction. FIG. 4(B) is a sectional view showing a section of the connecting blade 20 at the positions A2, B2, and C2 of FIG. 4(A), and FIG. 4(C) is a sectional view showing the connecting blade 20 at the intermediate positions A3 and B3 of FIG. 4(A).

Although not being illustrated, the connecting blade 20 at the positions A1, B1, and C1 and a section of the molding die have similar section to the sections taken at the intermediate positions A3 and B3 shown in FIG. 4(C). In addition, FIGS. 4(B) and 4(C) show only the grounding lines 26 and the signal lines 25 of the cross pair 24 with the molding die. Although the sections of the signal lines 23 of the straight pair 22 and the molding die located nearby are not illustrated, but the sections are similar to those of the signal lines 25 and the molding die located nearby at corresponding positions.

As shown in FIGS. 4(B) and 4(C), the molding die is composed of two dies that can be split in the sheet thickness direction of the lines 25 and 26 (in the up-and-down direction in FIGS. 4(B) and 4(C)).

Hereunder, as for those dies, the die illustrated as bottom in FIGS. 4(B) and 4(C) is referred to as "lower die P" and the die illustrated as top is referred to as "upper die Q".

As shown in FIGS. 4(B) and 4(C), the lower die P has a plurality of lower restricting thin protrusions P2 and a plurality of lower restricting protruding columns P3, which protrude from a molding surface (upper surface in FIGS. 4(B) and 4(C)) of a lower main body P1. The lower restricting thin protrusions P2 contact with a lower plate surfaces of the grounding lines 26 and restrict positions of the grounding lines 26 in cooperation with upper restricting thin protrusions Q2, which will be described later, in the sheet thickness direction of the grounding lines 26 (in the up-and-down direction in FIGS. 4(B) and 4(C)).

As shown in FIG. 4(B), at the positions A2, B2, and C2, the lower restricting protruding columns P3 contact with the side end surfaces and lower plate surfaces of the two signal lines 25 that are adjacent to each other, and restrict the positions in the width direction (left-and-right direction in FIG. 4(B)) and the sheet thickness direction (in the up-and-down direction in FIG. 4(B)) of the signal lines 25. Moreover, as shown in FIG. 4(C), at the intermediate positions A3 and B3, the lower restricting protruding columns P3 contact with the side end surfaces and the lower plate surfaces of the signal lines 25 and the grounding lines, which are adjacent to each other, at their shoulder parts. The lower restricting protruding columns P3 restrict positions in the width direction (left-and-right direction in FIG. 4(C)) and the sheet thickness direction (up-and-down direction in FIG. 4(C)) of the signal lines 25 and 26 in cooperation with upper restricting columns Q3, which will be described later.

The lower restricting thin protrusions P2 are formed at the intermediate positions of the grounding lines 26 in the width direction so as to extend in the longitudinal direction (a direction perpendicular to the paper surface in FIGS. 4(B) and 4(C)) of the grounding lines 26. As shown in FIGS. 4(B) and 4(C), upper surfaces of the lower restricting thin protrusions P2 contact by surface with lower surfaces (plate surfaces) of the grounding lines 26, and form flat surfaces to restrict downward movement of the grounding lines 26 in the sheet thickness direction.

The lower restricting protruding columns P3 are scattered on a molding surface of the lower main body P1. As shown in FIGS. 4(B) and 4(C), each of the lower restricting protruding columns P3 has a base portion P3A and a protrusion P3B. The base portions P3A protrude to be rectangular prisms from a molding surface (upper surface in FIGS. 4(B) and 4(C)) of the lower main body P1. The protrusions P3B protrude from the upper surface of the base portion P3A in the center area in the width direction of the base portion P3A.

At the positions A2, B2, and C2, as shown in FIG. 4(B), the base portions 3A are provided in the range over the side edges (inner edges) of the facing signal lines 25 in the width direction (the range including the two facing inner edges). At the intermediate positions A3 and B3, as shown in FIG. 4(C), the base portions P3A are formed in the range over the facing side edges of the signal lines 25 and the grounding lines 26 (the range including two side edges) in the width direction.

As shown in FIG. 4(C), the base portions P3A that are provided corresponding to the side edges of the grounding lines 26, i.e., the base portions P3A adjacent to the lower restricting thin protrusions P2 are integrally connected to the lower restricting thin protrusions P2 in the width direction. As shown in FIGS. 4(B) and 4(C), the upper surfaces of the base portions P3A (flat surfaces that are provided both sides of each of the protrusions P3B and form shoulder positions) contact by surface with lower surfaces (plate surfaces) of the side edges of the signal lines 25 or the grounding lines 26, and restrict downward movement of the lines 25 and 26 in the sheet thickness direction.

Moreover, as shown in FIG. 4(B), at the positions A2, B2, and C2, the protrusions P3B are located between the inner edges of the facing signal lines 25. At the intermediate positions A3 and B3, as shown in FIG. 4(C), the protrusions P3B are located between the outer edge of the signal line 25 and the side edge of the grounding line 26, which face each other. As shown in FIGS. 4(B) and 4(C), the protrusions P3B contact by their side surfaces with the side end surfaces of the signal lines 25 and the grounding lines 26, and restrict movement of the lines 25 and 26 in the width direction (left-and-right direction in FIGS. 4(B) and 4(C)).

As shown in FIGS. 4(B) and 4(C), the upper die Q includes a plurality of upper restricting thin protrusions Q2 and a plurality of upper restricting protruding columns Q3. The upper restricting thin protrusions Q2 and the upper restricting protruding columns Q3 are for restricting positions of the signal lines 25 and 26 upon integral molding, and protrude from a molding surface (lower surface in FIGS. 4(B) and 4(C)) of the upper main body Q1.

The upper restricting thin protrusions Q2 contact with upper plate surfaces of the grounding lines 26, and restrict positions of the grounding lines 26 in the sheet thickness direction (up-and-down direction in FIGS. 4(B) and 4(C)) of the grounding lines 26 in cooperation with the lower restricting thin protrusions P2.

As shown in FIG. 4(B), at the positions A2, B2, and C2, the upper restricting protruding columns Q3 contact with upper plate surfaces of two signal lines 25 that are adjacent to each other. The upper restricting protruding columns Q3 restrict positions of the signal lines 25 in the sheet thickness direction (the up-and-down direction in FIG. 4(B)) in cooperation with the lower restricting columns P3. In addition, as shown in FIG. 4(C), at the intermediate positions A3 and B3, the upper restricting protruding columns Q3 contact with upper plate surfaces of the signal line and the grounding line that are adjacent each other, and restrict positions of the lines 25 and 26 in the sheet thickness direction (the up-and-down direction in FIG. 3(C)).

The upper restricting thin protrusions Q2 are formed at the intermediate positions of the grounding lines 26 in the width direction so as to extend in the longitudinal direction (a direction perpendicular to the paper surface in FIGS. 4(B) and 4(C)) of the grounding lines 26. As shown in FIGS. 4(B) and 4(C), lower surfaces of the upper restricting thin protrusions Q2 contact by surface with lower surfaces (plate surfaces) of the grounding lines 26, and form flat surfaces to restrict upward movement of the grounding lines 26 in the sheet thickness direction.

As shown in FIG. 4(B), at the positions A2, B2, and C2, the upper restricting protruding columns Q3 are formed one by one corresponding to the side edges (inner edges) of the signal lines 25 that face each other in the width direction. As shown in FIG. 4(C), at the positions A3 and B3, the upper restricting protruding columns Q3 are formed one by one corresponding to the side edges (inner edges) of the signal line 25 and the grounding line 26 that face each other in the width direction. As shown in FIG. 4(C), the upper restricting protruding columns Q3 that are provided corresponding to the side edges of the grounding lines 26, i.e., the upper restricting protruding columns Q3 adjacent to the upper restricting thin protrusions Q2 are integrally connected to the upper restricting thin protrusions Q2 in the width direction.

As shown in FIGS. 4(B) and 4(C), the lower surfaces of the upper restricting protruding columns Q3 contact by surface with upper surfaces (plate surfaces) of the side edges of the signal lines 25 or the grounding lines 26, and restrict upward movement of the lines 25 and 26 in the sheet thickness direction.

Furthermore, each of spaces Q4 formed between each pair of the upper restricting protruding columns Q3 that are adjacent to each other has a shape so as to fit to the protrusions P3B of the lower die. As shown in FIGS. 4(B) and 4(C), once the lower die P and the upper die Q are put together, the protrusions P3B of the lower die P enter the spaces Q4, and thereby the protrusions P3B and pair of the upper restricting protruding columns Q3 are tightly assembled.

Upon manufacturing the connecting blade 20, the lines 23, 25, and 26 are arranged inside the lower die P in the order shown in FIG. 2(B). At this time, the lower restricting protruding columns P3 of the lower die P support the side edges of the respective corresponding lines 23, 25, and 26 with the upper surfaces of the base portions P3A. At the same time, the protrusions P3B enter between the lines 23, 25, and 25 from below, and restrict positions of the lines 23, 25, and 26 in the width direction with the side surfaces of the protrusions P3B (See FIGS. 4(B) and 4(C) for the lines 25 and 26).

Then, as shown in FIGS. 4(B) and 4(C), bringing the upper die Q from above, the upper die Q is combined with the lower die P. As a result, intermediate parts of the grounding lines 26 in the width direction are pinched to be held with the restricting thin protrusions P2 and Q2. At the same time, the side edges of the lines 23, 25, and 26 are pinched to be held by the base portions P3A of the lower restricting protruding columns and the upper restricting protruding columns Q3 in the up-and-down direction (sheet thickness direction).

Being held in the up-and-down direction, the lines 23, 25, and 27 are restricted from movements in the up-and-down direction and are kept at the normal positions. In addition, tips of the protrusions P3B of the lower restricting protruding columns P3 enter between the upper restricting protruding columns Q3, and contact by surface with the side end surfaces of the lines 23, 25, and 26 at their side surfaces, so as to restrict movements in the width direction of the lines 25 and 26. As a result, the lines 23, 25, and 26 are restricted from movements in the width direction and kept at the normal positions.

Next, injecting resin in the spaces formed between the molding dies P and Q, the lines 23, 25, and 26 are integrally molded with the insulation board 21 (See FIGS. 4(B) and 4(C) for the lines 25 and 26). Then, removing the both dies P and Q, the connecting blade 20 is obtained. Removing the both dies P and Q, in the range where the restricting thin protrusions P2 and Q2 are present, the both plate surfaces of the grounding lines 26 are exposed.

In addition, in the range where the restricting protruding columns P3 and Q3 are present, the window-like openings 27-2 and 28-2 and the notched portions 27-1, 27-3, 28-1, and 28-3 are formed on the insulation board 21 (see FIG. 2(C)). Thereafter, in the window-like openings 27-2 and 28-2 and the notched portions 27-1, 27-3, 28-1, and 28-3, the both plate surfaces and side end surfaces of the side edges of the corresponding lines 23, 25, and 26 are exposed. To the connecting blade 20 obtained in this way, a shielding plate (not illustrated) will be attached to both plate surfaces of the insulation board 21.

According to the embodiment, the two circuit connecting members to be connected by the lines of the connecting blade are connectors. Alternatively, at least one of the two circuit connecting members can be, for example, a circuit board. In this case, the lines of the connecting blade have contact points formed at ends on the side to be connected to the circuit board will be connected by soldering to a corresponding circuit portion of the circuit board.

According to the embodiment, the grounding lines are arranged at the same positions, i.e., on the same surface (imaginary surface) as the signal lines in the sheet thickness direction of the connecting blade. However, the positions to arrange the grounding lines are not limited to those, and the grounding lines can be arranged at different positions from those of the signal lines in the sheet thickness direction. For example, the grounding lines can be arranged at positions so as to have the plate surfaces face the signal lines in the sheet thickness direction. Moreover, in case of arranging the grounding lines in this way, the grounding lines can be arranged only one side of the signal lines in the sheet thickness direction, or can be arranged on the both sides.

Second Embodiment

In the first embodiment, only the side edges of the signal lines 23 and 25 are exposed from the insulation board 21, and surfaces of other parts are covered with the insulation board 21, so as to match impedance. According to the second embodiment, only very small area at the intermediate position of the signal lines in the width direction is exposed from the insulation board and other parts are covered with the insulation board, so as to match the impedance. This is a difference from the first embodiment.

Figure 5:
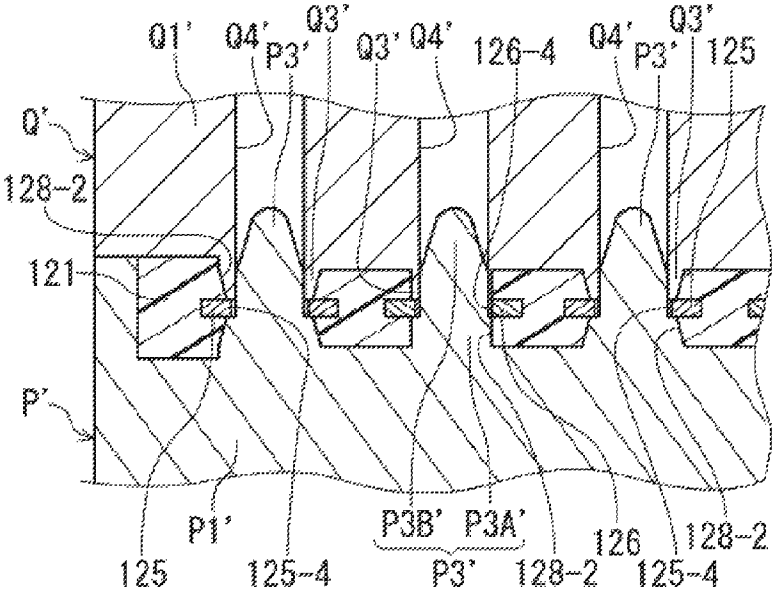
Figure 5:
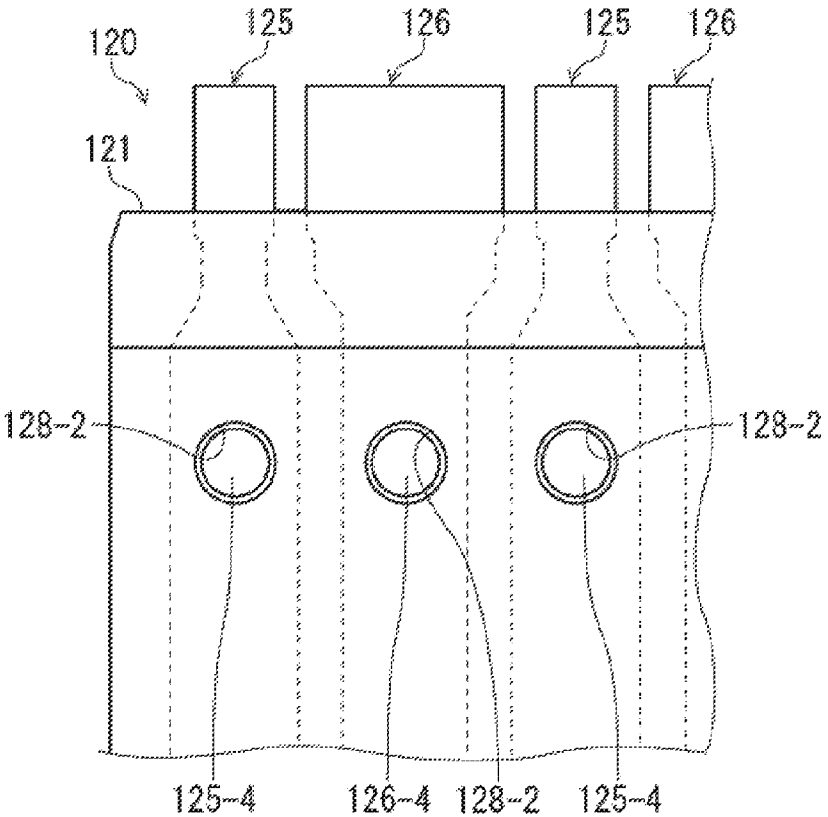

Hereunder, the second embodiment will be described based on FIGS. 5(A) and 5(B). FIG. 5(A) is a front view showing a part of the connecting blade 120. In the figure, parts of outer shapes of the signal lines 123 and 125 and the grounding lines 126, which are embedded in the insulation board 121, are indicated with broken lines. FIG. 5(B) is a sectional view of the connecting blade 120 with the molding die, which is taken at a surface perpendicular to the longitudinal direction of the lines. FIG. 5(B) shows a section at positions of restricting holes, which will be described later. According to the embodiment, differences from the first embodiment will be mainly described. Similar portions to those in the first embodiment will be indicated with reference numerals, to which "100" is added and explanation will be omitted.

As shown in FIG. 5(A), according to the embodiment, the signal lines 125 and the grounding lines 126 of the connecting blade 120 are alternately arranged in the width direction (a left-and-right direction in FIG. 5(A)) of the connecting blade 120. The signal lines 125 are formed to be wider than the signal lines 23 and 25 of the first embodiment.

As shown in FIG. 5(A), the lines 125 and 126 have restricting holes 125-4 and 126-4 in the intermediate area in the width direction of the lines 125 and 126 at positions close to the upper ends in the longitudinal direction, for restricting positions of the lines 125 and 126 in the width direction. The restricting holes are formed to penetrate in the sheet thickness direction of the lines 125 and 126 (a direction perpendicular to the paper surface in FIG. 5(A)). The restricting holes 125-4 and 125-4 are formed on each of the lines 125 and 126 at a plurality of positions in the up-and-down direction.

The insulation board 121 has window-like openings 128-2 as cutout portions that penetrate the insulation board 121 in the sheet thickness direction. The window-like openings 128-2 are concentric circles relative to the restricting holes 125-4 and 126-4 at positions corresponding to the restricting holes 125-4 and 126-4 of the respective lines 125 and 126.

As shown in FIG. 5(A), the window-like openings 128-2 are formed to have slightly larger diameter than those of the restricting holes 125-4 and 126-4. As a result, inside the window-like openings 128-2, a part of each of the lines 125 and 126, more specifically the both plate surfaces and inner circumferential end surfaces of the side edges (hereinafter referred to as "circumferential edges") that form the restricting holes, are exposed over the whole circumferences.

According to the embodiment, in the signal lines 125, in the range of the insulation board 121 in the longitudinal direction of the signal lines 125 (in the up-and-down direction in FIG. 5(A)), other than the above-described circumferential edges of the restricting holes 125-4, the both plate surfaces are covered by the insulation board 121. Therefore, the actual permittivity is high, and in turn the impedance is small in comparison with when the whole circumferential surfaces of the signal lines are exposed as in conventional technique. Therefore, similarly to the first embodiment, it is achievable to keep mismatching of impedance in the longitudinal direction of the signal lines 23 and 25 smaller than that in conventional technique.

According to the embodiment, in the window-like openings 128-2, the circumferential edges of the restricting holes 125-4 and 126-1 are exposed over the whole circumference of the restricting holes 125-4 and 126-4. Alternatively, the circumferential edges can be exposed in a part of the range of the restricting holes 125-4 and 126-4 in the circumferential direction. When signals to be transmitted by the signal lines 125 are high-speed signals, the high-speed signals tend to flow in the ridge lines (corners at a section perpendicular to the longitudinal direction) of the signal lines. According to the embodiment, the circumferential edges, where the signal lines 125 are exposed, are located in the center area of the signal lines 125 in the width direction, and the ridge lines are covered with the insulation board 121. Therefore, it is achievable to minimize influence on the transmission of high-speed signals due to the exposed circumferential edges.

As shown in FIG. 5(B), in the molding dies P' and Q' for integral molding of the respective lines 125 and 126 with the insulation board 121, the lower die P' has lower restricting protruding columns P3. The lower restricting protruding columns P3 have generally pin-like shape, and protrude from a molding surface (an upper surface in FIG. 5(B)) of the lower main body P1' and are formed at positions corresponding to the restricting holes 125-4 and 125-6 of the respective lines 125 and 126 in the width direction. Regardless of which lines to correspond to, any of the lower restricting protruding columns P3' is formed to have the same shape.

Each of the lower restricting protruding columns P3' is provided corresponding to the center areas of the lines 125 and 126 in the width direction and has a base portion P3A' and a protrusion P3B'. The base portions P3A' protrude from a molding surface (upper surface in FIG. 5(B)) of the lower main body P1'. The protrusions P3B' protrude from the upper surfaces of the base portions P3A'. According to the embodiment, the base portions P3A' corresponding to the signal lines 125 have conical shapes, and the basal portions P3A' corresponding to the grounding lines 126 have circular cylindrical shapes.

As shown in FIG. 5(B), the upper surfaces (flat surfaces of parts around the protrusions P3B') of the circumferential edges of the basal portions P3A contact by surface with lower surfaces (plate surfaces) of the circumferential edges of the holes to be restricted 125-4 and 126-4 formed on the lines 125 and 126, and restrict downward movement of the lines 125 and 126 in the sheet thickness direction.

As shown in FIG. 5(B), lower parts of the protrusions P3B' are cylindrical having slightly smaller diameter than those of the upper surface of the basal portions P3A', and upper parts of the protrusions P3B' are tapered. As shown in FIG. 5(B), the protrusions P3B are inserted in the holes to restricted 125-4 and 126-4 of the lines 125 and 126. The circumferential surfaces of lower parts of the protrusions P3B' face inner circumferential sheet thickness surfaces of the restricting holes 125-4 and 126-4. As a result, movement of the lines 125 and 126 in the width direction (left-and-right direction in FIG. 5(B)) is restricted.

The upper die Q' includes a plurality of upper restricting protrusions Q3' and a plurality of upper restricting holes Q4', to restrict positions of the lines 125 and 126 upon integral molding. The upper restricting protrusions Q3' are provided at positions corresponding to the restricting holes 125-4 and 126-4 of the lines 125 and 126, and protrude from a molding surface (a lower surface in FIG. 5(B)) of the upper main body Q1.

According to the embodiment, the upper restricting protrusions Q3' corresponding to the signal lines 125 have conical outer shapes. The upper restricting protrusions Q3' corresponding to the grounding lines 126 have circular cylindrical shapes. Any of the upper restricting protrusions Q3' have slightly larger diameters at the protruding top surfaces (lower surfaces in FIG. 5(B)) than those of the restricting holes 125-4 and 126-4.

As shown in FIG. 5(B), lower surfaces of the circumferential edges of the upper restricting protrusions Q3' (flat surfaces of circumferences of the upper restricting holes Q4', which will be described later) contact with upper surfaces (plate surfaces) of the circumferential edges of the restricting holes 125 and 126 of the lines 125 and 126 and restricts upward movement of the lines 125 and 126 in the sheet thickness direction.

As shown in FIG. 5(B), the upper restricting holes Q4' have circular shapes having generally the same diameter as that of the restricting holes 125-4 and 126-4 when viewed in the up-and-down direction (see FIG. 5(B)). The upper restricting holes Q4' extend in the up-and-down direction, penetrating the upper restricting protrusions Q3' and even the upper main body Q1'. The upper restricting holes Q4' receive the protrusions P3B' of the lower die P' from below, while being in a state that the lower die P' and the upper die Q' are combined, upon integral molding.

Upon manufacturing the connecting blade 120, the signal lines 125 and the grounding lines 126 are alternately arranged inside the lower die P. At this time, into the restricting holes of the lines 125 and 126, the protrusions P3B' of the lower restricting protruding columns P3' are inserted downwardly. As a result, movement of the lines 125 and 126 in the width direction is restricted by the side surfaces of the lower part of the protrusions P3B'. Accordingly, being restricted from displacement of the positions in the width direction, the lines 125 and 126 are kept in the normal positions. In addition, the base portions P3A' of the lower restricting protruding columns P3' support the circumferential edges of the restricting holes 125-4 and 126-4 of the lines 125 and 126 from below. As shown in FIG. 5(B), bringing the upper die Q' from above, the upper die Q' is combined with the lower die P'. As a result, the circumferential edges of the restricting holes 125-4 and 126-4 of the lines 125 and 126 are pinched to be held with base portions P3A' of the lower restricting protruding columns P3' and the upper restricting protrusions Q3' in the up-and-down direction (sheet thickness direction). As a result, the lines 125 and 126 are restricted from displacement in the up-and-down direction and kept at the normal positions.

Next, injecting resin in the spaces formed between the molding dies P' and Q', the lines 125 and 126 are integrally molded with the insulation board 121 as shown in FIG. 5(B). Then, removing the both dies P' and Q', the connecting blade 120 is obtained. Removing the both dies P' and Q', in the range where the lower restricting thin protruding columns P3' and the upper restricting protrusions Q3' are present, window-like openings 128-2 are formed on the insulation board 121. Then, in the window-like openings 128-2, the both plate surfaces of the circumferential portions of the corresponding holes to be retained 125-4 and 126-4 of the lines 125 and 126 and side end the both plate surfaces thereof are exposed. To the connecting blade 120 obtained in this way, a shielding plate (not illustrated) can be attached to both plate surfaces of the insulation board 121 as necessary.

Third Embodiment

According to the first embodiment, inside the window-like openings 27-2 and 28-2 and the notched portions 27-1, 27-3, 28-1, and 28-3, which are formed as cutout portions penetrating the insulation board 21 in the sheet thickness direction, side edges of the lines 23, 25, and 26 are respectively exposed. According to the third embodiment, there are formed concave portions as cutout portions that are dented from the plate surface of the insulation board 21, and side edges of the respective lines are exposed in the concave portions, which is a difference from the first embodiment.

Hereunder, the third embodiment will be described based on FIGS. 6(A) through 6(C). FIG. 6(A) is a front view showing a part of the connecting blade 220 according to the third embodiment. In the figure, parts of outer shapes of the signal lines 225 and 1 the grounding lines 226, which are embedded in the insulation board 221, are indicated with broken lines. FIGS. 6(B) and 6(C) are sectional views of the connecting blade 220 with the molding die, taken at a surface perpendicular to the up-and-down direction. FIG. 6(B) is the sectional view at the positions A2, B2, and C2 of FIG. 6(A), and FIG. 6(C) is the sectional view at the intermediate positions A3 and B3 of FIG. 6(A). In this embodiment, corresponding portions to those in the first embodiment will be indicated with reference numerals, to which "200" is added including portions not illustrated in the figures Hereunder, the third embodiment will be described mainly focusing on differences from the first embodiment.

Although not being illustrated, the connecting blade 220 at the positions A1, B1, and C1 and the molding dies P" and Q" have similar sections to the sections taken at the intermediate positions A3 and B3 shown in FIG. 6(C). In addition, FIGS. 6(B) and 6(C) show only the grounding lines 226 and the signal lines 225 of the cross pair 224 with the molding dies P" and Q". Although the sections of the signal lines 223 of the straight pair 222 and the molding dies P" and Q" located nearby are not illustrated, but the sections are similar to those of the signal lines 225 and the molding dies P" and Q" located nearby at corresponding positions.

As shown in FIG. 6(A), the whole shape of the insulation board 221 is similar to that of the insulation board 21 of the first embodiment. However, instead of the window-like openings 28-2 of the insulation board 21, the holed concaved portions 228-2, which will be described later, are formed as cutout portions, and instead of the notched portions 28-3, notched concave portions 228-3, which will be described later, are formed as cutout portions. Similarly, although not being illustrated, in the insulation board 221, there are formed holed-concave portions 227-2 (not illustrated) in place of the window-like portions of the insulation board 21 in the first embodiment, and notched concave portions 227-1, 227-3, and 228-1 (not illustrated) in place of the notched portions 27-1, 27-3, and 28-1.

As shown in FIG. 6(A), the holed concave portions 228-2 are formed at the same positions as those of the window-like portions 28-2 in the first embodiment, and are formed as concave portions dented from one plate surface (a plate surface visible in FIG. 6(A) and a lower surface in FIG. 6(B)) of the insulation board 221. As well shown in FIG. 6(B), the holed concave portions do not penetrate the insulation board 221 at the positions.

As shown in FIG. 6(B), the holed concave portions 228-2 include shallow concave portions 228-2A and deep concave portions 228-2B, which will be described later. The shallow concave portions 228-2A are formed close to one plate surface of the insulation board 221 in the sheet thickness direction. The deep concave portions 228-2B are formed close to the other plate surface than the shallow concave portions 228-2A.

As shown in FIG. 6(B), the shallow concave portions 228-2A are formed over the side edges (hereinafter referred to as "inner edges) of one pair of signal lines 225, which are adjacent to and face each other, in the width direction (left-and-right direction in FIG. 6(B)). The shallow concave portions 228-2A are formed under lower surfaces of the signal lines 225 (on the side of the other plate surface of the insulation board 221) in the sheet thickness direction (in the up-and-down direction in FIG. 6(B)). In the shallow concave portions 228-2A, at the both side positions in the width direction, plate surfaces (plate surface that is visible in FIG. 6(A) and the plate surface provided on the lower side in FIG. 6(B)) of the inner edges of the wide positions 225-2 of the respective signal lines 225 are exposed. In addition, at the positions between the inner edges of each pair of the signal lines 225 in the width direction, the deep concave portions 228-2B extend upward than the lower surfaces of the signal lines 225 in the sheet thickness direction of the insulation board 221, and reach above the upper surfaces of the signal lines 225. In the deep concave portions 228-2B, at the both side positions in the width direction, the side end surfaces (sheet thickness surfaces) of the inner edges of the wide portions 225-2 of the respective signal lines 25 are exposed.

Furthermore, according to the third embodiment, in the both plate surfaces of the signal lines 225, the whole areas of the plate surfaces located on the upper side in FIG. 6(B) (backside in FIG. 6(A)) are covered with the insulation board 221 and are not exposed.

In other words, at the positions A2, B2, and C2, only the side end surfaces of the inner edges of the wide portions 225-2 and the one plate surfaces of the inner edges (plate surfaces located on the lower side in FIG. 6(B)) are exposed in the holed concave portions 228-2 and other parts are covered with the insulation board 221.

Figure 6:
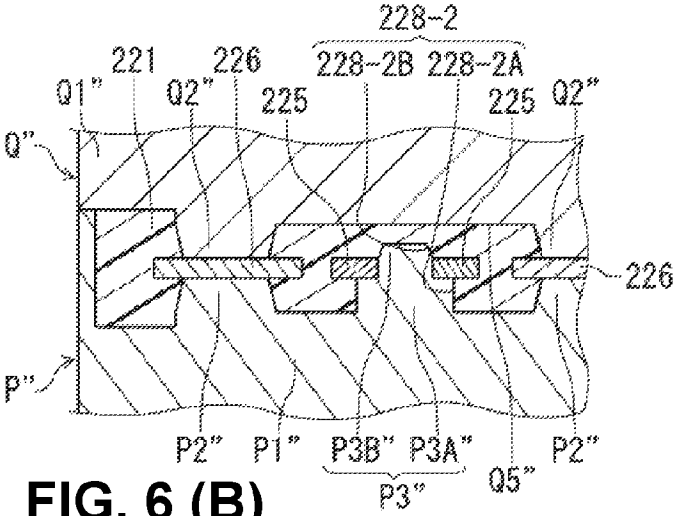
Figure 6:
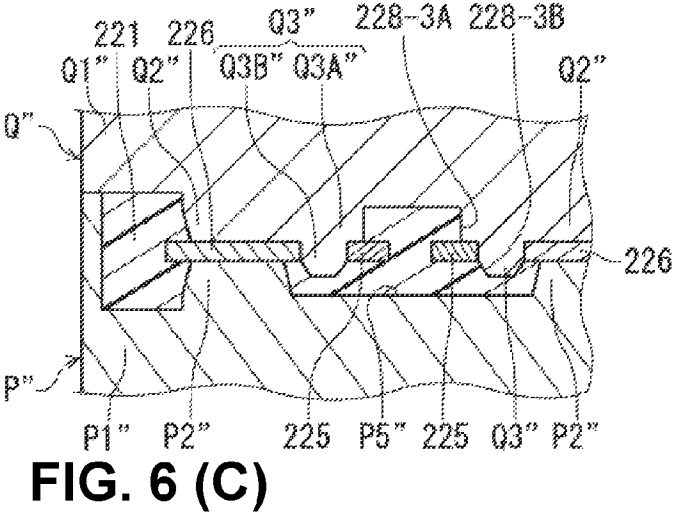
Figure 6:
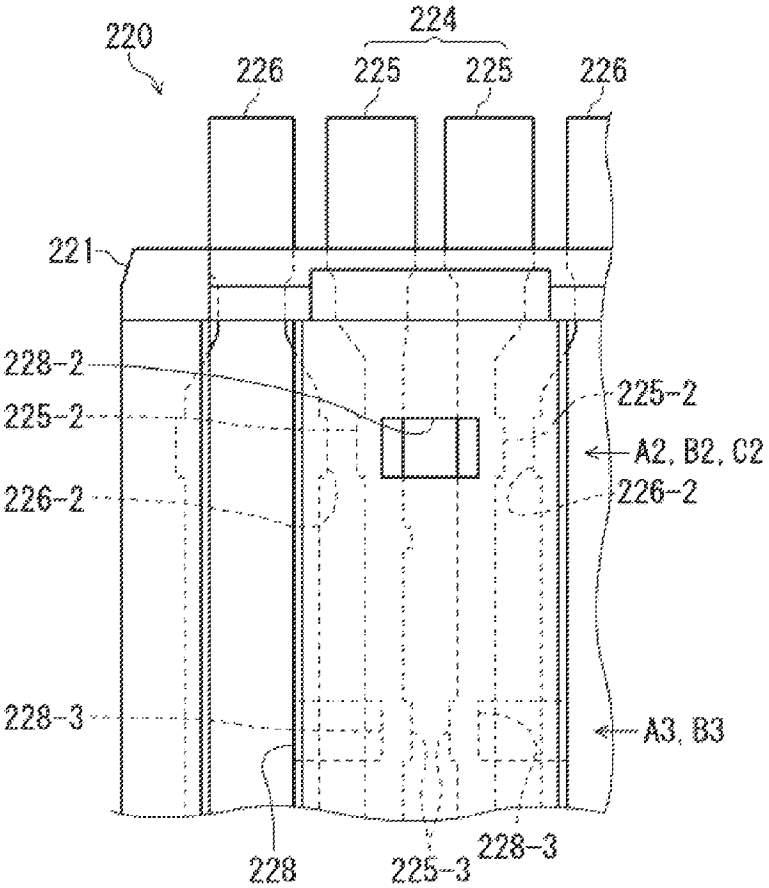

As indicate with the broken lines in FIG. 6(A), the notched concave portions are formed at the same positions as those of the notched portions 28-3 in the first embodiment, when viewed in the sheet thickness direction of the insulation board 221 (a direction perpendicular to the paper surface in FIG. 6). The notched concave portions 228-3 are formed as concave portions that are dented from the other plate surface of the insulation board 221 (the plate surface located on the backside in FIG. 6(A), an upper surface in FIG. 6(C)). As well shown in FIG. 6(C), the notched concave portions 228-3 do not penetrate the insulation board 221 at the positions. In addition, the notched concave portions 228-3 are opened outward in the width direction at both side edges of each of the embedding strips 228, when viewed in the sheet thickness direction of the insulation board 221.

As shown in FIG. 6(C), the notched concave portions 228-3 include shallow concave portions 228-3A and deep concave portions 228-3B. The shallow concave portions 228-3A are formed close to the other plate surface of the insulation board 221 in the sheet thickness direction. The deep concave portions 228-3B are formed close to the one plate surface than the shallow concave portions 228-3A.

As shown in FIG. 6(C), the shallow concave portions 228-3A extend over the facing side edges of the signal line 225 and the grounding line 225 that are adjacent to each other in the width direction (left-and-right direction in FIG. 6(C)). The shallow concave portions 228-3A are formed above the upper surfaces of the signal lines 225 (on the side of the other plate surface of the insulation board 221) in the sheet thickness direction (up-and-down direction in FIG. 6(C)).

The shallow concave portions 228-3 are opened on the side of the grounding lines 226 in the width direction. In the shallow concave portions 228-3A, at the inner positions (positions on the side that is not opened) in the width direction, plate surfaces (plate surface that is not visible in FIG. 6(A) and the plate surface provided on the upper side in FIG. 6(B)) of the outer edges of the wide positions 225-3 of the respective signal lines 225 are exposed.

In addition, at the positions between facing side edges of the signal line 225 and the grounding line 226 that are adjacent to each other in the width direction, the deep concave portions 228-3B extends under the upper surfaces of the signal lines 225 in the sheet thickness direction of the insulation board 221 and reach below the lower surfaces of the signal lines 225. In the deep concave portions 228-3B, at the inner side positions in the width direction, the side end surfaces (sheet thickness surfaces) of the outer edges of the wide portions 225-3 of the respective signal lines 25 are exposed.

Furthermore, according to the third embodiment, in the both plate surfaces of the signal lines 225, as for the plate surfaces located at the lower part (closer to the front side in FIG. 6(A)) in FIG. 6(C), the whole area thereof in the width direction is covered with the insulation board 221 and is not exposed.

In other words, at the positions A3 and B3, only the side end surfaces of the outer edges of the wide portions 225-2 and the one plate surfaces of the outer edges (plate surfaces located in an upper portion of FIG. 6(B)) are exposed in the notched concave portions 228-2 and other parts are covered with the insulation board 221.

According to the third embodiment, as described above, in the holed concave portions 228-2 and in the notched concave portions 228-3, only side end surfaces of one side edge and the one plate surfaces of the side ends of the signal lines 225 are exposed. In the other words, according to the third embodiment, the exposed area is smaller for the one plate surfaces of the side edges, in comparison with when the side end surfaces of the side edges of one side and the both plate surfaces of the signal lines are exposed in the window-like openings or in the notched portions. Therefore, according to the third embodiment, the permittivity is even larger and the impedance is small. Therefore, it is surely achievable to reduce the mismatching of the impedance in the longitudinal direction of the signal lines 225.

As shown in FIGS. 4(B) and 4(C), in the molding dies P" and Q" for integral molding of the respective lines 225 and 226 with the insulation board 221, the lower die P" includes lower restricting thin protrusions P2", lower restricting protruding columns P3", and lower concave portions P5". The lower restricting thin protrusions P2" have the same shape as that of the lower restricting thin protrusions P2 of the lower die P2, which was described in the first embodiment, so that the explanation is omitted. The lower restricting thin protrusions P3" are provided at the positions A2, B2, and C2. As shown in FIG. 6(B), the lower restricting protruding columns P3" have a shape of the lower restricting protruding columns P3 of the lower die P2, but with shorter protrusions P3B. The lower concave portions P5" are provided at the intermediate positions A3 and B3. As shown in FIG. 6(C), in the rage between the side edges (side edges that face the outer edges of the signal lines 225) of the grounding lines 226 located on the both sides of one pair of the signal lines 225 in the width direction, the lower concave portions P5" are formed to be dented from the upper surface of the lower die P".

As shown in FIG. 6(C), while being in a state that the dies P" and Q" are combined with each other, the bottom surfaces of the lower concave portions P5" are located lower than lower ends of the protrusions Q3B of upper restricting protruding columns Q3", which are provided on the die Q" and will be described later.

The upper die Q" includes upper restricting thin protrusions Q2", upper restricting protruding columns Q3", and upper concave portions Q5". The upper restricting thin protrusions Q2" have the same shape as that of the upper restricting thin protrusions Q2 of the upper die Q2, which was described in the first embodiment, so that the explanation is omitted. The upper restricting protruding columns Q3" are provided at the intermediate positions A3 and B3. A FIG. 6(C), the upper restricting protruding columns Q3" have the shape of the upper restricting protruding columns Q3 of the upper die Q2, which was described in the first embodiment, but with shorter protrusions Q3B.

The upper concave portions Q5" are provided at the positions A2, B2, and C2. As shown in FIG. 6(B), in the rage between the side edges (side edges that face the outer edges of the signal lines 225) of the grounding lines 226 located on the both sides of one pair of the signal lines 225 in the width direction, the upper concave portions Q5" are formed to be dented from the lower surface of the upper die Q". As shown in FIG. 6(B), while being in a state that the dies P" and Q" are combined with each other, the bottom surfaces of the upper concave portions Q5" are located above upper ends of the protrusion P3B" of the lower restricting protruding columns P3" of the lower die P", which are already described above.

Upon manufacturing the connecting blade 220, the lines 223, 225, and 226 are arranged inside the lower die P" in the same order of the lines 23, 25, and 26 in FIG. 2(B). At this time, the lower restricting protruding columns P3" of the lower die P" support the side edges of the respective corresponding lines 223 and 225 with the upper surfaces of the base portions P3A". At the same time, the protrusions P3B" enter between the lines 223 and 225 from below, and restrict positions of the lines 223 and 225 in the width direction with the side surfaces of the protrusions P3B" (See FIG. 6(C) for the lines 225 and 226).

As shown in FIGS. 6(B) and 6(C), bringing the upper die Q" from above, the upper die Q" is combined with the lower die P". As a result, intermediate parts of the grounding lines 226 in the width direction are pinched to be held with the restricting thin protrusions P2" and Q2" in the up-and-down direction (sheet thickness direction). Being held in the up-and-down direction, the grounding lines 226 are restricted from movement in the up-and-down direction and are kept at the normal positions.

In addition, as shown in FIG. 6(C), the upper restricting protruding columns Q3" of the upper die Q" support the side edges of the respective corresponding lines 223, 225, and 226 with the upper surfaces of the base portions Q3A". At the same time, the protrusions Q3B" enter between the lines 223, 225, and 226 from below, and restrict positions of the lines 223, 225, and 226 in the width direction with the side surfaces of the protrusions Q3B" (See FIG. 6(C) for the lines 225 and 226). Being held by the base portions P3A" of the lower restricting protruding columns P3" and the base portions Q3A" of the upper restricting protruding columns Q3" in the up-and-down direction, the lines 223, 225, and 226 are restricted from movement in the up-and-down direction and are kept at the normal positions.

Next, injecting resin in the spaces formed between the molding dies P" and Q", the lines 223, 225, and 226 are integrally molded with the insulation board 221 (See FIGS. 6(B) and 6(C) for the lines 225 and 226). Then, removing the both dies P" and Q", the connecting blade 220 is obtained. Removing the both dies P" and Q", in the range where the restricting thin protrusions P2" and Q2" are present, the both plate surfaces of the grounding lines 226 are exposed. In addition, in the range where the restricting protruding columns P3" and Q3" are present, the holed concave portions 227-2 and 228-2 and the notched concave portions 227-1, 227-3, 228-1, and 228-3 are formed on the insulation board 221. To the connecting blade 220 obtained in this way, a shielding plate (not illustrated) can be attached to both plate surfaces of the insulation board 221 as necessary.

What is claimed is:

1. A connecting blade comprising:

an insulation board; and a signal line disposed on the insulation board, said signal line having contact points at both ends thereof for connecting to a circuit connecting member, said signal line being formed of a metal band member, wherein said signal line is arranged on the insulation board in a width direction of the signal line, said insulation board includes a cut portion penetrating through the insulation board or being recessed in a plate surface of the insulation board, said signal line includes a wide width portion at a position corresponding to the cut portion, and said cut portion is situated at a position where the cut portion exposes a side edge surface and a plate surface of the wide width portion of the signal line.

2. The connecting blade according to claim 1, wherein said cut portion includes a first cut portion and a second cut portion situated on each side of the signal line, respectively.

3. The connecting blade according to claim 2, wherein said first cut portion is situated at a position different from that of the second cut portion along a longitudinal direction of the signal line.

4. The connecting blade according to claim 1, wherein said signal line includes a restricted hole portion for restricting a position thereof, and said cut portion is situated at the position where the cut portion exposes at least a part of the restricted hole portion.

5. An electrical connector, comprising:

a housing to be connected to a mating connector; and the connecting blade held with the housing according to claim 1, wherein said housing includes an opening portion at a position where the contact points of the connecting blade are located, and said contact points of the connecting blade contact with the mating connector when the mating connector is connected to the housing.

6. A connecting blade, comprising:

an insulation board;

a signal line disposed on the insulation board, said signal line having contact points at both ends thereof for connecting to a circuit connecting member, said signal line being formed of a metal band member; and a ground line disposed on the insulation board adjacent to the signal line, wherein said signal line is arranged on the insulation board in a width direction of the signal line, said insulation board includes a cut portion penetrating through the insulation board or being recessed in a plate surface of the insulation board, said cut portion is situated at a position where the cut portion exposes a part of the signal line, said ground line includes a first side edge situated at a position corresponding to the cut portion and a second side edge situated at a position outside the cut portion, and said first side edge is situated closer to the signal line than the second side edge.

7. The connecting blade according to claim 6, wherein said cut portion is situated at the position where the cut portion exposes a plate surface of a side edge portion and a side edge surface of the signal line.

8. The connecting blade according to claim 6, wherein said cut portion includes a first cut portion and a second cut portion situated on each side of the signal line, respectively.

9. The connecting blade according to claim 8, wherein said first cut portion is situated at a position different from that of the second cut portion along a longitudinal direction of the signal line.

10. The connecting blade according to claim 6, wherein said signal line includes a restricted hole portion for restricting a position thereof, and said cut portion is situated at the position where the cut portion exposes at least a part of the restricted hole portion.

11. The connecting blade according to claim 6, wherein said signal line includes a wide width portion at a position corresponding to the cut portion.

12. An electrical connector, comprising:

a housing to be connected to a mating connector; and the connecting blade held with the housing according to claim 6, wherein said housing includes an opening portion at a position where the contact points of the connecting blade are located, and said contact points of the connecting blade contact with the mating connector when the mating connector is connected to the housing.

13. A connecting blade comprising:

an insulation board;

a first signal line disposed on the insulation board; and a second signal line disposed on the insulation board and extending in parallel to the first signal line, wherein said insulation board includes a plurality of cut portions each penetrating through the insulation board or being recessed in a plate surface of the insulation board so that one side edge of the first signal line and one side edge of the second signal line are exposed through single one of the cut portions.

* * * * *